United States Patent [19]

Friel

[11] Patent Number: 4,897,965

[45] Date of Patent: Feb. 6, 1990

[54] KNIFE SHARPENING APPARATUS

[76] Inventor: Daniel D. Friel, P.O. Box 4319, Greenville, Del. 19807

[21] Appl. No.: 304,323

[22] Filed: Jan. 31, 1989

Related U.S. Application Data

[63] Continuation-in-part of Ser. No. 917,601, Oct. 6, 1986, Pat. No. 4,807,399, which is a continuation-in-part of Ser. No. 588,794, Mar. 12, 1984, Pat. No. 4,627,194, and Ser. No. 855,147, Apr. 23, 1986, Pat. No. 4,716,689, which is a continuation-in-part of Ser. No. 588,795, Mar. 12, 1984, abandoned.

[51] Int. Cl.[4] ..... B24B 3/54

[52] U.S. Cl. ..... 51/128; 51/241 G; 51/109 BS; 51/116

[58] Field of Search ..... 51/57, 58, 60, 74 BS–92 BS, 51/108 BS, 98 BS, 109 BS, 116, 119, 128, 102, 6, 205 WG, 208, 210, 214, 241 G, 285, 170 MT; 269/8

*Primary Examiner*—D. S. Meislin

*Attorney, Agent, or Firm*—Connolly and Hutz

[57] ABSTRACT

A knife sharpening apparatus includes a moving abrasive surface. A magnetic guide has a guide surface in a plane disposed at a predetermined angle which intersects the plane of the abrasive surface. The magnetic guide is made from a magnetized material having opposite polarity north and south magnetic pole faces with a first ferromagnetic member located against one pole and a second non-planar ferromagnetic member located in part against the other pole and in part extending parallel to the guide surface and contiguous to the magnetized material. The second ferromagnetic member is located at the surface remote from the abrasive surface.

7 Claims, 2 Drawing Sheets

KNIFE SHARPENING APPARATUS

CROSS-REFERENCE TO RELATED APPLICATIONS

This application is a continuation-in-part of application Ser. No. 917,601 filed Oct. 6, 1986 now U.S. Pat. No. 4,807,399 which in turn is a continuation-in-part of application Ser. No. 588,794 filed Mar. 12, 1984 now U.S. Pat. No. 4,627,194 and Ser. No. 855,147 filed Apr. 23, 1986 now U.S. Pat. No. 4,716,689 which in turn is also a continuation-in-part of Ser. No. 588,795 filed Mar. 12, 1984 now abandoned.

BACKGROUND OF INVENTION

My U.S. Pat. No. 4,627,194, issued Dec. 9, 1986 and its related patents disclose a knife sharpener using magnetic quides which are particularly effective in directing and holding the knife against the moving abrasive surface during the sharpening process. Those patents disclose the knife sharpener as having a pre-sharpening section and honing sections. The abrasive element is rotatably driven in the pre-sharpening section and is orbitally driven in the honing sections. The orbital drive is such that the motion of each abrasive element is limited to a velocity of 800 feet per minute and ±0.005 inches in a direction perpendicular to the principle plane (plane of the abrasive surface) and has an orbital length per revolution for each abrasive element of less than about one inch. The orbital motion is also disclosed as inparting to each of the abrasive particles a velocity of no greater than 1500 feet per minute and a motion of no greater than ⅜ inches effective diameter.

It is also disclosed that the orbital velocity should be between 15–1500 feet per minute and that the angle at which the knife is inserted into each honing section should differ in one honing sectiion as compared to the other honing section. Further it is disclosed that the abrasive means should comprise diamond particles with generally flat faces.

The knife sharpener has met with great success, particularly for sharpening knives having normal width blades. There is a need for such a sharpener which can effectively sharpen blades which are very narrow, such as penknives, or which are very wide.

SUMMARY OF INVENTION

An object of this invention is to provide a knife sharpener of the above type wherein the magnetic guide gives good holding-guiding action on either wide faced blades or very narrow faced penknife type blades.

A further object of this invention is to provide such a knife sharpener which will sharpen all of the blade length to the handle and still accommodate narrow penknife blades.

In accordance with this invention a knife sharpener of the type disclosed in my above patents includes magnetic guides made from a magnetized material having opposite polarity north and south magnetic poles. A feromagnetic plate is located at each pole. The first plate is disposed against one pole. The second plate however is partly against its pole parallel to the one plate and partly extending down the guide surface contiguous to the magnetized material. The second plate is at the surface remote from the abrasive surface.

THE DRAWINGS

DETAILED DESCRIPTION

Figure 1:
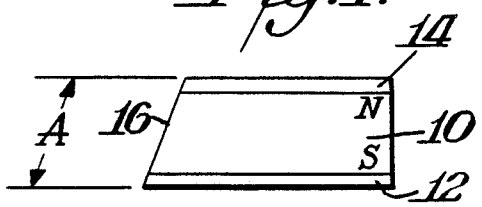
FIG. 1 is a cross-sectional elevation view schematically illustrating a magnetic guide usable in a knife sharpener as in my prior patents.

FIG. 1 illustrates the magnet configuration of a magnetic guide 10 of the type used with knife sharpeners of my patents. As shown therein the magnetic guide includes parallel ferromagnetic plates 12, 14 and has north and south poles N and S. The guide surface 16 is inclined in a plane which intersects the moving abrasive surface, not shown. Guide surface 16 has a length or dimension A.

Figure 2A:
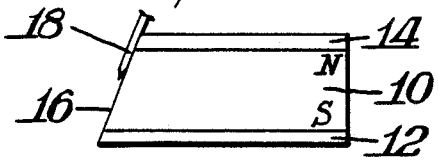
FIGS. 2A and 2B are views similar to FIG. 1 showing a narrow knife blade against the magnetic guide.
Figure 2B:
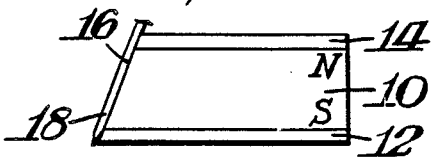

If the face of the blade 18 is smaller than A, the blade 18 will hangup on the upper plate 14, as shown in FIG. 2A, unless blade 18 is physically forced by the user to the position shown in FIG. 2B. The magnetic field concentrated in the ferromagnetic pole plates 12,14 forces the knife 18 to hangup either in the upper or the lower position. These positions offer the lowest resistance paths for magnetic flux. The knife could theoretically be stable at one point exactly midway between the poles—but that has no practical significance as the knife will in fact move with the smallest disturbance to one or other of the plates.

It is desired that the blade facet be pulled by the magnet structure down and into position against the moving abrasive. If the knife "hangs up" on the upper ferromagnetic structures and the facet does not reach the abrasive, this can mislead the operator to believe the knife is being sharpened when in fact it is not. The knife would not be touching the diamond abrasive particles. If the operator is perceptive enough to push the blade to the lower ferromagnetic pole plate, the facet may or may not touch the abrasive depending on the geometry of the knife, the pole spacings, and the spacing (gap) between the lower pole piece and the abrasive. There is another serious problem when the too narrow blade is forced to the lower position—namely an angular instability of the knife against the guide plane—since the blade does not in that case contact the upper pole plate. The lack of contact at upper pole reduces the magnetic flux through the knife and the lack of good contact (or close proximity) at the upper plate makes the blade less stable against a twisting action on the blade. It is a strong magnetic pull from the upper plate which establishes and maintains a good angular control of the blade against the guide plane.

In practice the magnet structure is recessed behind the guide plane by a few thousandths of an inch (e.g. 1–15 thousandths). As a practical matter with realistic manufacturing tolerances, there is commonly maintained a "set back" of 3–8 thousandths in order to, prevent a protrusion of magnetic material that could scratch the face of the blade. It is at least theoretically possible for actual contact of the knife with the magnet structure.

With a blade that is too narrow or a gap that is too wide, (as discussed above) it is possible to manually force the blade down until the facet strikes the abrasive. However, one has to then maintain pressure on the blade to sharpen the knife.

Thus, with the prior magnet structures one has difficulties when the blade width is smaller than the size of the magnetic gap. In order to effectively hold blades of small width, the gap must be small. However, if the gap is made smaller, the stability of wide width blades and heavy blades is reduced during sharpening.

Figure 3:
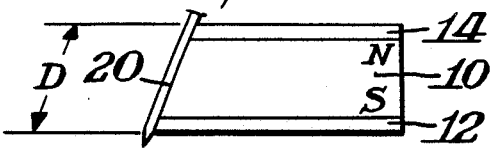
FIGS. 3–4 are views similar to FIG. 2 illustrating principles on which present invention is based.

The stability of a blade is controlled by the torque generated by the magnetic structure. With a simple magnetic structure the torque can be illustrated as in FIG. 3 where D is the distance between plates 12 and 14.

The torque on a given blade 20 with a face longer than the distance D is simply proportional to the distance (D) multiplied by the flux strength (F) of the magnet. So the Torque=kF.D. The factor k is dependent upon the magnetic permeability of the blade metal and the thickness of air space if any between the face of the blade and the effective magnetic poles. The blade can be in contact with the magnet or can be deliberately held some 0.003–015 inch from the blade.

Figure 4:
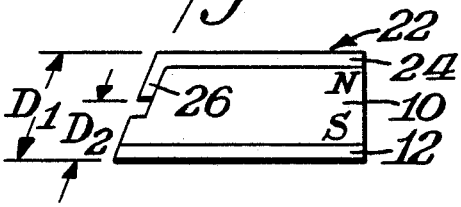

A geometry that I have discovered to be effective is illustrated in FIG. 4 where plate 14 is replaced by a bent plate 22. As shown therein, plate 22 includes a portion 24 parallel to plate 12 and includes a bent down toe 26 to conduct all or a portion of the flux from the North pole to a point closer to the lower South pole plate. This structure is ideal for smaller knives that have a blade width on the order of D2 and substantially less than $D_1$. If the blade width is $D_1$ or greater the structure of FIG. 3 produces a greater torque and a more stable knife during sharpening than the structure of FIG. 4 assuming the same size magnet in both cases and provided that (a) the upper ferromagnetic plate 22 is sufficiently thick to conduct all the flux to the end of the toe 26 and (b) that the knife is in intimate contact with the toe 26.

The design of FIG. 4 permits the use of thick magnetic material to give enhanced magnetic flux and torque for the smaller knife.

While the magnetic structure design of FIG. 4 with a toe performs well with narrow width blades such as pocket knives, the torque on larger width blades is less than if the toe were removed. Of course if the toe were removed, blades of narrower width would hang up on either the top or lower plate and there would be no "pull down" against the diamond abrasive particles.

Accordingly what is needed is a magnetic structure that will provide reasonable torque with either a small or large width knife.

Figure 5:
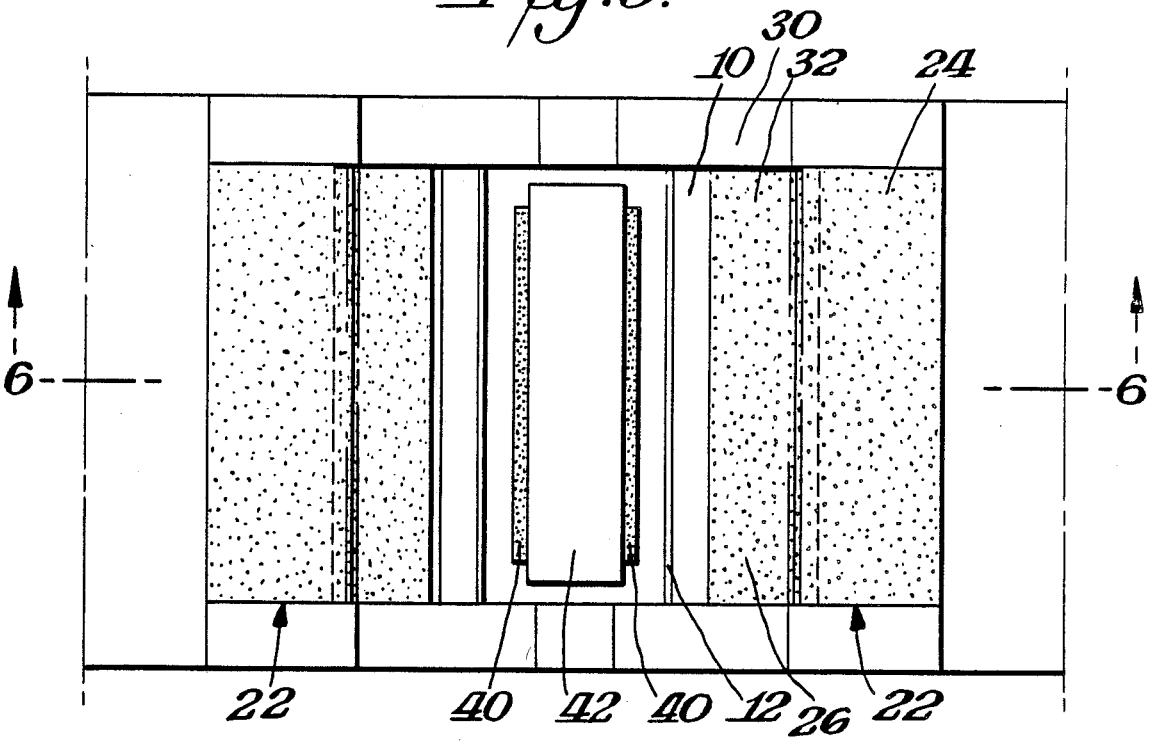
FIG. 5 is a top plan view of a portion of a knife sharpener in accordance with this invention.
Figure 6:
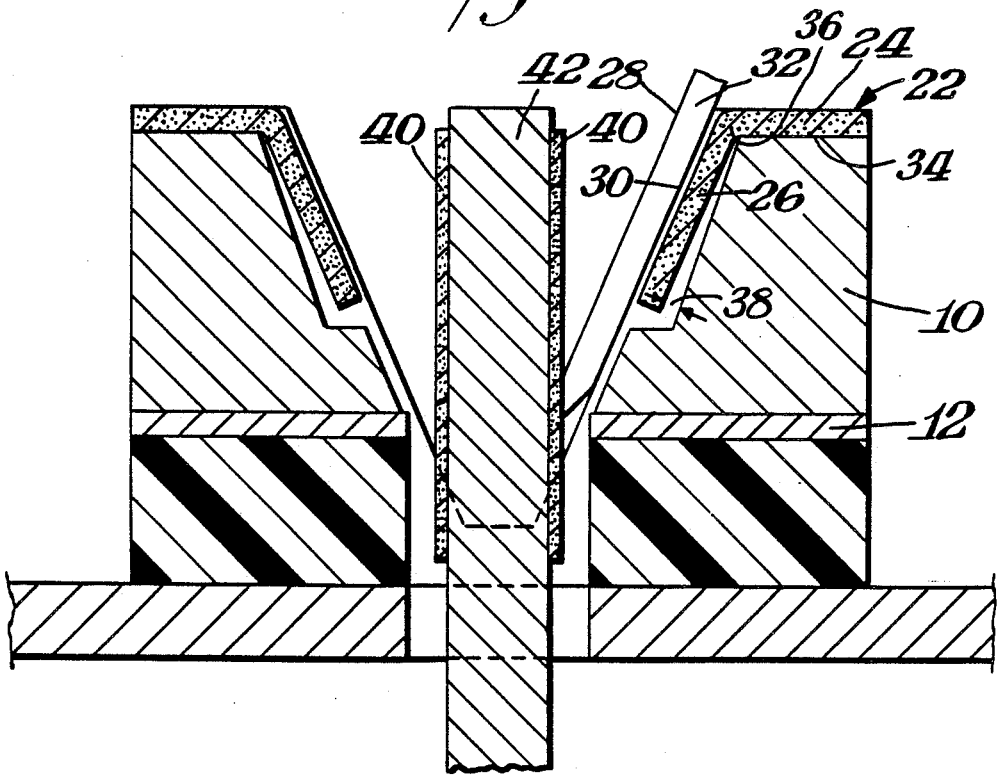
FIG. 6 is a cross-sectional view taken through FIG. 5 along the 6—6.

What I have found surprising is that if an upper plate is used with a thickness insufficient to conduct all of the flux to the tip of the toe there will be significant flux leakage at the knee of the upper plate to knives of wider width. This increases the torque on wider knives without seriously reducing the flux and torque for knives of reduced width. FIGS. 5–6 illustrate the many factors that influence an optimal magnetic structure design in accordance with this invention. FIGS. 5–6 are drawn to 5× scale and accurately illustrates a preferred embodiment of this invention.

Referring to FIG. 6, the knife 28 rests on a guide plane 30 which is shown spaced 0.007 inches from the face 32 of the toe 26 of the upper metal plate 22. The toe 26 is shown as parallel to the face of the knife. The under side 34 of the upper plate 22 ideally is in intimate contact with the upper surface of the magnet 10 to maximize the magnetic flux in the upper plate 22. In the vicinity of the upper plate knee 36 the magnet would ideally be in intimate contact with the metal plate. (FIG. 6 illustrates a 0.005 inch clearance for constructional purposes). The lower metal plate 12 is spaced approximately 0.005 inch from the knife face in FIG. 5–6. The knife 28 could in fact rest against the magnetic structure, but the separation (0.007) offers some advantages.

Because the thickness of the upper plate 22 is insufficient to conduct all of the magnetic flux from the upper (arbitrarily called north) pole, some of the upper plate flux in the vicinity of the knee 36 and along the length of the toe 26 leaks out to the knife 28 which in turn conducts the flux to the lower plate 12. With the magnet strength of an actual embodiment, a 1/32 inch thick metal plates allowed sufficient leakage to give increased torque on larger knives. An upper plate thickness of 1/16 inch would carry essentially all the flux and there would be little leakage at the knee.

The amount of flux leakage at the knee 36 can be adjusted by the plate thickness, distance of the knee to the knife, and separation of the toe and knife face. It is possible to adjust the relative flux that goes down to the end of the toe and to the knife face simply by adjusting the separation of the knife face and the end of the toe. I have found in practice that constructing the toe to be parallel to the knife and adjusting the metal thickness provides a good compromise to accommodate both wide blade and narrow blade knives.

I have found it desirable also to have a gap 38 between the lower end of the toe and the magnetic material. (FIG. 6 shows a 0.020 inch gap.) Such a gap 38 reduces short-circuiting of flux through the magnetic material directly to the toe 26. It is desirable that the principal flux path be through the upper metal plate 22 so as to adjust the amount of flux leakage at the knee and the amount out the toe. It is also desirable that the spacing between the toe end and magnetic material be greater than the spacing between the toe end and the blade 28 in order to minimize short circuiting of flux down the toe and into the magnetic material rather than through the blade.

With a wide face knife there is flux leakage at the knee 36, some along the face of the toe, and some at the end of the toe. These flux lines create a torque on the blade as described above. With a blade of smaller width—for example just wide enough to span the gap from the end of the toe to the lower plate—flux is conducted down to the toe and to the blade creating a torque. Of course by using tee thinner upper metal plate the amount of flux reaching a knife of smaller width is less than the total flux conducted to a larger knife. Consequently this unique magnetic structure provides a means to meter the amount of flux conducted to knives of different width and provide adequate torque for virtually all conventional knives.

A physical separation between the blade and magnetic structure minimizes scratching of the blade and permits better control of the point where the flux is concentrated and directed to the blade. Ideally one wants the flux to leak to the blade at the top of the magnetic structure when the blade is larger than the structure—in order to maximize the torque. When the blade width is smaller than the magnetic structure one wants the magnetic flux to concentrate near the top of the blade width.

In order to optimize performance over a range of blade widths the spacing from the end of the toe to the lower plate should not be much smaller than the smallest blade width to be accommodated. As one reduces this spacing (normally about 0.10 to 0.15 inch) the overall torque on wider blades is noticeably reduced compared to structures with larger spacing between end of the toe 26 and the lower plate 12.

As with earlier magnet designs it is desirable to adjust the position of the lower metal plate relative to the abrasive surface so that the magnetic forces pull the knife facet against the abrasive 40 on moving substrate 42 and hold the knife facet against the abrasive 40 during sharpening. I have found a separation of about 0.035 inch provides sufficient pull down with all knives tested.

If the separation of the lower plate 12 from the metal plate 42 on which abrasive diamonds 40 are electroplated is less than about 0.035 inches significant magnet flux is conducted from the lower metal plate to the abrasive metal plate 42. This creates an adverse situation where the tip of the knife blade (as the blade is lowered into the sharpening slot) is attracted to the metal plate and the lower portions of the knife face is pulled away from the angular guide surface. This destroys the accuracy of angular control and severely interferes with creation of good edges. I have found that with separations of less than 0.015 inch this condition existed with certain knives as a serious problem.

If the lower metal plate 12 is located too far behind the guide plane 30, less flux will pass through the blade 28, and the attraction (pull) of the magnetic forces holding the blade 28 against the guide plane 30 is reduced. At the same time, the pull down force (pulling the blade 28 against the diamonds 40) is reduced. I have found the optimum position of the lower metal plate 12 to be about 0.035 inch from the diamond face 40 of the abrasive surface.

Figure 7:
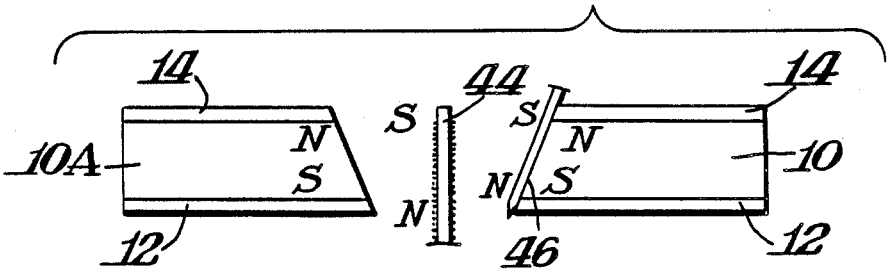
FIG. 7 is a cross-sectional view of magnetic guides in accordance with another aspect of this invention.

FIG. 7 relates to another aspect of this invention. In a sharpener where there is more than one sharpening slot and more than one magnetic structure I have discovered there are surprising interactions of the magnetic fields that effect the stability of a knife in the guide. I have found that when there are abrasive coated metal plates 44 it is important that the magnetic fields of adjacent magnetic structures 10,10A be similarly oriented, that is with poles aligned and similar poles in the same direction. For example it is desirable that both North poles be up and both South poles down or visa versa, as shown in FIG. 7.

As shown in FIG. 7, the magnetic structure 10A on the left induces magnetic poles in the abrasive coated metal plate 44 that are oriented opposite in polarity to the left magnet. Similarly the magnetic structure 10 on the right induces poles in the knife 46 that are opposite to the right magnet. The poles induced in the abrasive coated plate 44 and in the knife 46 have identical orientation. The identical polarity has the advantage of repelling the knife against the guide plane. Thus the knife experiences a pull by the right magnetic structure 10 and a push from the abrasive coated metal plate 44. This adds stability to the knife positioning against the guide. The force from the abrasive coated plate 44 is the smaller of the two forces. I have found that if the polarity of the left magnetic structure 10A is reversed, polarity in the abrasive coated plate 44 is of course also reversed and the knife blade 46 with its opposite polarity can be attracted to the metal plate. If the blade is inserted accurately on the guide plane this reverse polarity effect is not a serious problem. However, if one inserts the blade less accurately it can be attracted to the metal plate causing possible damage to the knife. It also creates an unacceptable instability of knife position from the users viewpoint.

What is claimed is:

1. In a knife sharpening apparatus for sharpening a knife having a face terminating at a cutting edge facet, comprising a sharpening member having a moving abrasive surface, said abrasive surface being in a plane, means to impart motion to said abrasive surface, magnetic knife quide means having a magnetic guide surface lying in a plane disposed at a predetermined angle to and intersecting said plane of said abrasive surface to form a line of intersection therewith, the improvement being in that said magnetic knife guide means is composed of a magnetized material having opposite polarity north and south magnetic pole faces with a first ferromagnetic member located substantially against one magnetic pole face and a second ferromagnetic member, said second ferromagnetic member having one portion which lies in one plane and a second portion which lies in an intersecting plane, said second ferromagnetic member being located in part against the other magnetic pole face where a portion of the second ferromagnetic member extends finitely in a direction parallel to the plane of the magnetic guide surface and essentially contiguous to the magnetized material, said second member being disposed along a portion of said magnetic guide surface remote from said abrasive surface, and said first of said ferromagnetic members being located along a portion of said magnetic guide surface which is contiguous to said abrasive surface to create a magnetic field along said magnetic guide surface to hold the knife against said magnetic guide surface and move the knife therealong into engagement with said moving abrasive surface.

2. The sharpener of claim 1 wherein the magnetic field also creates a force to hold the cutting edge in contact with said abrasive surface while said abrasive surface is in motion.

3. The sharpener of claim 1 wherein the distance between said first ferromagnetic member and said abrasive surface is in the range of 0.015 to 0.075 inch.

4. The sharpener of claim 12 wherein the distance between said first ferromagnetic member and the extending portion of said second ferromagnetic member is in the range of 0.080 to 0.150 inch.

5. The sharpener of claim 1 including an adjacent second magnetic guide means where the polarity of the ferromagnetic members is nominally the same so that like polarity poles of the ferromagnetic members are located directly opposite each other.

6. A knife sharpening apparatus for sharpening a knife comprising a sharpening member consisting of ferromagnetic plate means, an abrasive coated surface on opposite sides of said plate means, means to impart motion to said abrasive surfaces, at least two magnetic knife guide means, each of said guide means having a magnetic guide surface in a plane disposed at a predetermined angle to and intersecting the plane of a respective one of said abrasive surfaces to form a line of intersection therewith, and each of saidagnetic knife guide means including magnetized material having opposite polarity north and south magnetic poles wherein the orientation of the magnetic poles and fields of the magnetized material contained in each adjacent guide means is essentially identical with like magnetic poles being located directly opposite each other.

7. The apparatus of claim 6 wherein said plate means is a single plate.

* * * * *